US007204185B2

(12) United States Patent
Ma et al.

(10) Patent No.: US 7,204,185 B2
(45) Date of Patent: Apr. 17, 2007

(54) HYDRAULIC SYSTEM HAVING A PRESSURE COMPENSATOR

(75) Inventors: Pengfei Ma, Naperville, IL (US); Gene Richard St. Germain, Plainfield, IL (US); Jiao Zhang, Naperville, IL (US); Aleksandar M. Egelja, Naperville, IL (US); Robert Scot Lehmann, Dunlap, IL (US); Michael A. Sorokine, Naperville, IL (US)

(73) Assignees: Caterpillar Inc, Peoria, IL (US); Shin Caterpillar Mitsubishi Ltd (JP)

( * ) Notice: Subject to any disclaimer, the term of this patent is extended or adjusted under 35 U.S.C. 154(b) by 0 days.

(21) Appl. No.: 11/117,385

(22) Filed: Apr. 29, 2005

(65) Prior Publication Data

US 2006/0243128 A1 Nov. 2, 2006

(51) Int. Cl.
*F15B 13/04* (2006.01)

(52) U.S. Cl. ..... 91/446; 91/454

(58) Field of Classification Search ..... 91/446, 91/447, 454; 60/452
See application file for complete search history.

(56) References Cited

U.S. PATENT DOCUMENTS

| | | | |
|---|---|---|---|
| 3,366,202 | A | 1/1968 | James |
| 4,046,270 | A | 9/1977 | Baron et al. |
| 4,222,409 | A | 9/1980 | Budzich |
| 4,250,794 | A | 2/1981 | Haak et al. |
| 4,316,486 | A | 2/1982 | Tandrup et al. |
| 4,416,187 | A | 11/1983 | Nystrom |
| 4,437,385 | A | 3/1984 | Kramer et al. |
| 4,480,527 | A | 11/1984 | Lonnemo |
| 4,581,893 | A | 4/1986 | Lindbom |
| 4,586,330 | A | 5/1986 | Watanabe et al. |
| 4,623,118 | A | 11/1986 | Kumar |
| 4,662,601 | A | 5/1987 | Andersson |
| 4,706,932 | A | 11/1987 | Yoshida et al. |
| 4,711,267 | A | 12/1987 | Schwelm |
| 4,747,335 | A | 5/1988 | Budzich |
| 4,799,420 | A | 1/1989 | Budzich |
| 5,137,254 | A | 8/1992 | Aardema et al. |
| 5,152,142 | A | 10/1992 | Budzich |
| 5,211,196 | A | 5/1993 | Schwelm |

(Continued)

FOREIGN PATENT DOCUMENTS

| | | |
|---|---|---|
| JP | 02613041 B2 | 5/1997 |

OTHER PUBLICATIONS

U.S. Appl. No. 11/117,384, filed Apr. 29, 2005.

*Primary Examiner*—Michael Leslie
(74) *Attorney, Agent, or Firm*—Finnegan, Henderson, Farabow, Garrett & Dunner

(57) ABSTRACT

A hydraulic system having a source of pressurized fluid and a fluid actuator with a first chamber and a second chamber. The hydraulic system also has a first valve configured to selectively fluidly communicate the source with the first chamber and a second valve configured to selectively fluidly communicate the source with the second chamber. The hydraulic system also has a supply passageway and a signal passageway each disposed between the first and second valves in parallel. The hydraulic system also has a proportional pressure compensating valve configured to control a pressure of a fluid directed between the source and the first and second valves. The hydraulic system further has a fluid passageway disposed between the supply and signal passageways to fluidly communicate the supply and signal passageways.

41 Claims, 3 Drawing Sheets

U.S. PATENT DOCUMENTS 5,287,794 A 2/1994 Andersson
5,297,381 A 3/1994 Eich et al.
5,313,873 A 5/1994 Gall et al.
5,350,152 A 9/1994 Hutchison et al.
5,366,202 A 11/1994 Lunzman
5,447,093 A 9/1995 Budzich
5,477,677 A 12/1995 Krnavek
5,537,818 A 7/1996 Hosseini et al.
5,553,452 A 9/1996 Snow et al.
5,568,759 A 10/1996 Aardema
5,678,470 A 10/1997 Koehler et al.
5,701,933 A 12/1997 Lunzman
5,813,226 A 9/1998 Krone et al.
5,813,309 A 9/1998 Taka et al.
5,857,330 A 1/1999 Ishizaki et al.
5,868,059 A 2/1999 Smith
5,878,647 A 3/1999 Wilke et al.
5,890,362 A 4/1999 Wilke
5,947,140 A 9/1999 Aardema et al.
5,960,695 A 10/1999 Aardema et al.
6,009,708 A 1/2000 Miki et al.
6,026,730 A 2/2000 Yoshida et al.
6,082,106 A 7/2000 Hamamoto
6,216,456 B1 4/2001 Mitchell
6,367,365 B1 4/2002 Weickert et al.
6,397,655 B1 * 6/2002 Stephenson ..... 73/1.72
6,408,622 B1 6/2002 Tsuruga et al.
6,467,264 B1 10/2002 Stephenson et al.
6,502,393 B1 1/2003 Stephenson et al.
6,502,500 B2 1/2003 Yoshino
6,516,614 B1 2/2003 Knoll
6,598,391 B2 7/2003 Lunzman et al.
6,619,183 B2 9/2003 Yoshino
6,655,136 B2 12/2003 Holt et al.
6,662,705 B2 12/2003 Huang et al.
6,691,603 B2 2/2004 Linerode et al.
6,694,860 B2 2/2004 Yoshino
6,715,402 B2 4/2004 Pfaff et al.
6,718,759 B1 4/2004 Tabor
6,725,131 B2 4/2004 Lunzman
6,732,512 B2 5/2004 Pfaff et al.
6,748,738 B2 6/2004 Smith
6,761,029 B2 7/2004 Linerode
2003/0121256 A1 7/2003 Mather
2003/0121409 A1 7/2003 Lunzman et al.
2003/0125840 A1 7/2003 Lunzman et al.
2003/0196454 A1 10/2003 Jensen et al.
2004/0055288 A1 3/2004 Pfaff et al.
2004/0055289 A1 3/2004 Pfaff et al.
2004/0055452 A1 3/2004 Tabor
2004/0055453 A1 3/2004 Tabor
2004/0055454 A1 3/2004 Pfaff et al.
2004/0055455 A1 3/2004 Tabor et al.
2006/0090460 A1 5/2006 Ma et al.

* cited by examiner

HYDRAULIC SYSTEM HAVING A PRESSURE COMPENSATOR

TECHNICAL FIELD

The present disclosure relates generally to a hydraulic system, and more particularly, to a hydraulic system having a pressure compensator.

BACKGROUND

Work machines such as, for example, dozers, loaders, excavators, motor graders, and other types of heavy machinery use one or more hydraulic actuators to accomplish a variety of tasks. These actuators are fluidly connected to a pump on the work machine that provides pressurized fluid to chambers within the actuators. An electro-hydraulic valve arrangement is typically fluidly connected between the pump and the actuators to control a flow rate and direction of pressurized fluid to and from the chambers of the actuators.

Work machine hydraulic circuits that fluidly connect multiple actuators to a common pump may experience undesirable pressure fluctuations within the circuits during operation of the actuators. In particular, the pressure of a fluid supplied to one actuator may undesirably fluctuate in response to operation of a different actuator fluidly connected to the same hydraulic circuit. These pressure fluctuations may cause inconsistent and/or unexpected actuator movements. In addition, the pressure fluctuations may be severe enough and/or occur often enough to cause malfunction or premature failure of hydraulic circuit components.

One method of reducing these pressure fluctuations within the fluid supplied to a hydraulic actuator is described in U.S. Pat. No. 5,878,647 (the '647 patent) issued to Wilke et al. on Mar. 9, 1999. The '647 patent describes a hydraulic circuit having two pairs of solenoid valves, a variable displacement pump, a reservoir tank, and a hydraulic actuator. One pair of the solenoid valves includes a head-end supply valve and a head-end return valve that connects a head end of the hydraulic actuator to either the variable displacement pump or the reservoir tank. The other pair of solenoid valves includes a rod-end supply valve and a rod-end return valve that connects a rod end of the hydraulic actuator to either the variable displacement pump or the reservoir tank. Each of these four solenoid valves is associated with a different pressure compensating check valve. Each pressure compensating check valve is connected between the associated solenoid valve and the actuator to control a pressure of the fluid between the associated valve and the actuator.

Although the multiple pressure compensating valves of the hydraulic circuit described in the '647 patent may reduce pressure fluctuations within the hydraulic circuit, they may increase the cost and complexity of the hydraulic circuit. In addition, the pressure compensating valves of the '647 patent may not control the pressures within the hydraulic circuit precise enough for optimal performance of the associated actuator.

The disclosed hydraulic cylinder is directed to overcoming one or more of the problems set forth above.

SUMMARY OF THE INVENTION

In one aspect, the present disclosure is directed to a hydraulic system. The hydraulic system includes a source of pressurized fluid and a fluid actuator with a first chamber and a second chamber. The hydraulic system also includes a first valve configured to selectively fluidly communicate the source with the first chamber, and a second valve configured to selectively fluidly communicate the source with the second chamber. The hydraulic system also includes a supply passageway configured to direct pressurized fluid from the source to the first and second valves in parallel. The hydraulic system also includes a signal passageway disposed between the first and second valves, the first and second valves being connected in parallel with the signal passageway. The hydraulic system also includes a proportional pressure compensating valve configured to control a pressure of a fluid directed between the source and the first and second valves. The hydraulic system further includes at least one fluid passageway disposed between the supply and signal passageways to fluidly communicate the supply and signal passageways.

In another aspect, the present disclosure is directed to a hydraulic valve unit that includes a valve body. The valve body includes a first valve configured to selectively fluidly communicate a source of pressurized fluid with a first chamber of a fluid actuator and a second valve configured to selectively fluidly communicate the source with a second chamber of the fluid actuator. The valve body also includes a supply passageway disposed between the first and second valves in parallel. The valve body further includes a proportional pressure compensating valve disposed within the supply passageway between the source and the first and second valves. The proportional pressure control valve is configured to control a pressure of fluid directed between the first and second valves.

In another aspect, the present disclosure is directed to a method of operating a hydraulic system. The method includes pressurizing a fluid, directing the pressurized fluid via a supply passageway to a first valve in communication with a first chamber of a fluid actuator, and directing the pressurized fluid to a second valve via the supply passageway in communication with a second chamber of the fluid actuator. The method also includes selectively operating at least one of the first and second valves to move the fluid actuator. The method also includes directing pressurized fluid from a signal passageway disposed downstream of the first and second valves to a pressure compensating valve element and directing pressurized fluid from the supply passageway to the signal passageway via at least one fluid passageway. The method further includes moving a proportional pressure compensating valve element in response to pressures at an inlet and an outlet of one of the first and second valves to maintain a pressure differential across the one of the first and second valves within a predetermined range of a desired pressure differential.

DETAILED DESCRIPTION

Figure 1:
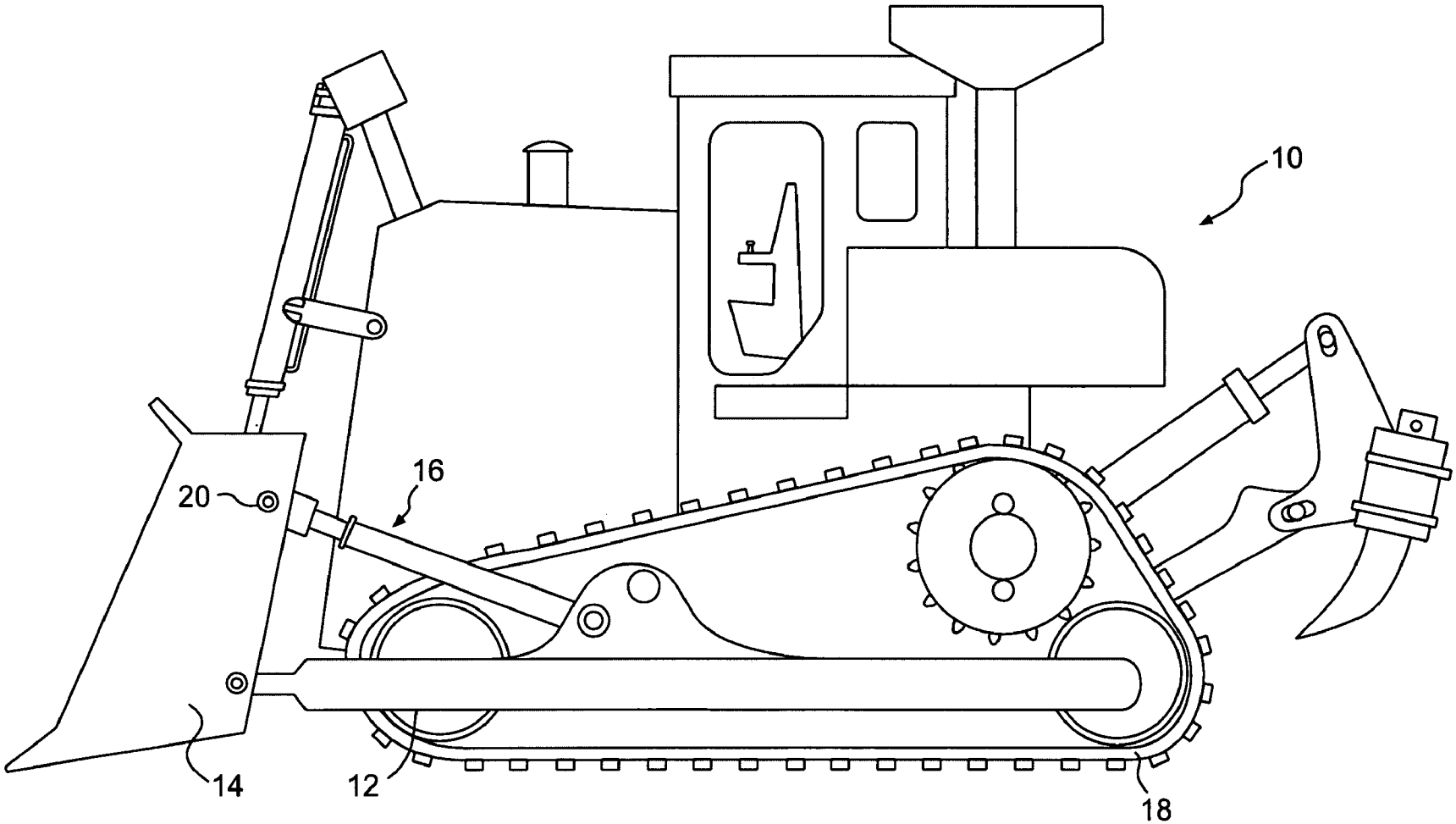
FIG. 1 is a side-view diagrammatic illustration of a work machine according to an exemplary disclosed embodiment.

FIG. 1 illustrates an exemplary work machine 10. Work machine 10 may be a fixed or mobile machine that performs some type of operation associated with an industry such as mining, construction, farming, or any other industry known in the art. For example, work machine 10 may be an earth moving machine such as a dozer, a loader, a backhoe, an excavator, a motor grader, a dump truck, or any other earth moving machine. Work machine 10 may also include a generator set, a pump, a marine vessel, or any other suitable operation-performing work machine. Work machine 10 may include a frame 12, at least one work implement 14, and at least one hydraulic cylinder 16 connecting work implement 14 to frame 12. It is contemplated that hydraulic cylinder 16 may be omitted, if desired, and a hydraulic motor included.

Frame 12 may include any structural unit that supports movement of work machine 10. Frame 12 may be, for example, a stationary base frame connecting a power source (not shown) to a traction device 18, a movable frame member of a linkage system, or any other type of frame known in the art.

Work implement 14 may include any device used in the performance of a task. For example, work implement 14 may include a blade, a bucket, a shovel, a ripper, a dump bed, a propelling device, or any other task-performing device known in the art. Work implement 14 may be connected to frame 12 via a direct pivot 20, via a linkage system with hydraulic cylinder 16 forming one member in the linkage system, or in any other appropriate manner. Work implement 14 may be configured to pivot, rotate, slide, swing, or move relative to frame 12 in any other manner known in the art.

Figure 2:
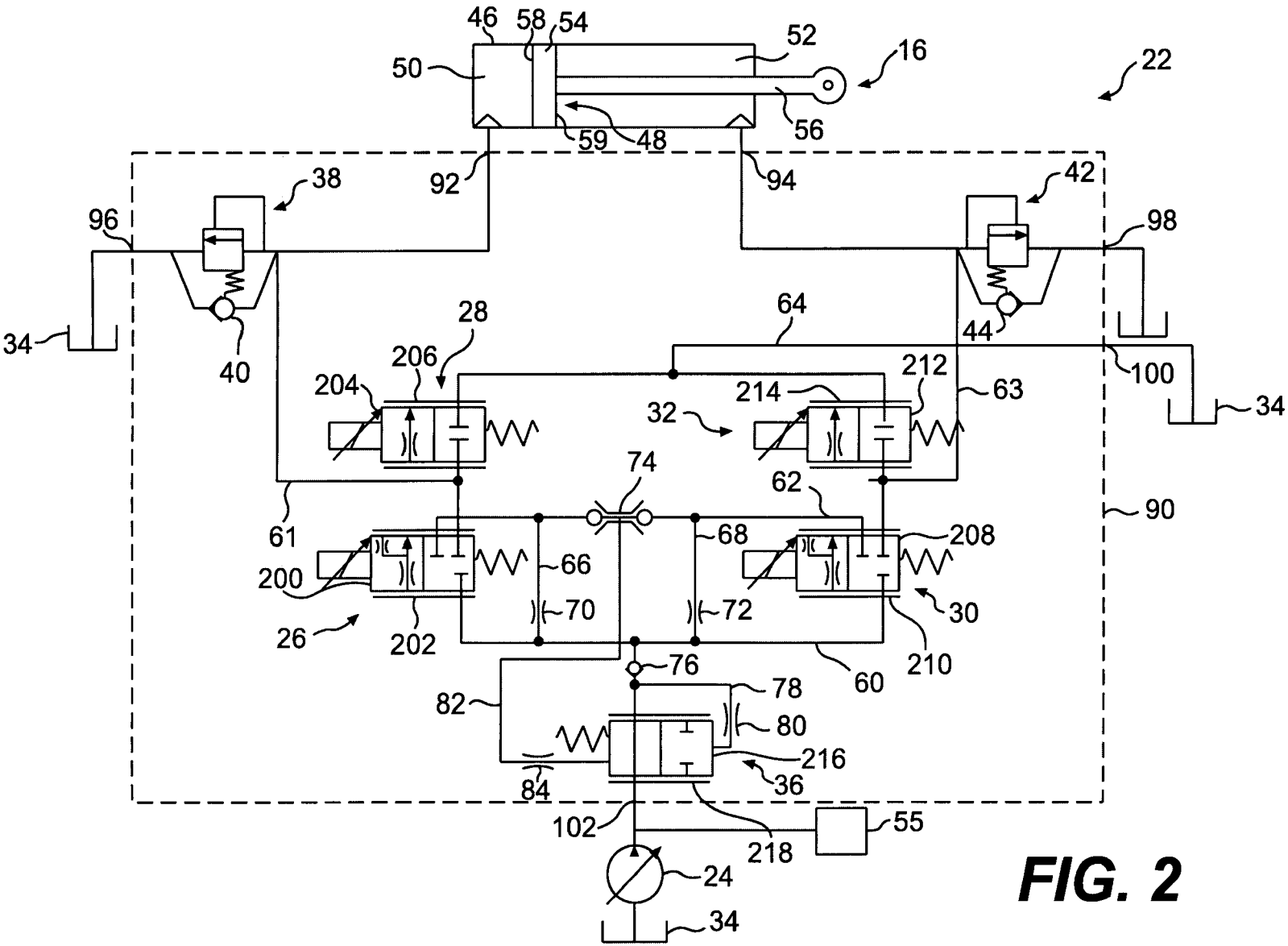
FIG. 2 is a schematic illustration of an exemplary disclosed hydraulic circuit.

As illustrated in FIG. 2, hydraulic cylinder 16 may be one of various components within a hydraulic system 22 that cooperate to move work implement 14. Hydraulic system 22 may include a source 24 of pressurized fluid, a tank 34, and a valve body 90. It is contemplated that hydraulic system 22 may include additional and/or different components such as, for example, a pressure sensor, a temperature sensor, a position sensor, a controller, an accumulator, and other components known in the art.

Hydraulic cylinder 16 may include a tube 46 and a piston assembly 48 disposed within tube 46. One of tube 46 and piston assembly 48 may be pivotally connected to frame 12, while the other of tube 46 and piston assembly 48 may be pivotally connected to work implement 14. It is contemplated that tube 46 and/or piston assembly 48 may alternately be fixedly connected to either frame 12 or work implement 14. Hydraulic cylinder 16 may include a first chamber 50 and a second chamber 52 separated by piston assembly 48. The first and second chambers 50, 52 may be selectively supplied with a fluid pressurized by source 24 and fluidly connected with tank 34 to cause piston assembly 48 to displace within tube 46, thereby changing the effective length of hydraulic cylinder 16. The expansion and retraction of hydraulic cylinder 16 may function to assist in moving work implement 14.

Piston assembly 48 may include a piston 54 axially aligned with and disposed within tube 46, and a piston rod 56 connectable to one of frame 12 and work implement 14 (referring to FIG. 1). Piston 54 may include a first hydraulic surface 58 and a second hydraulic surface 59 opposite first hydraulic surface 58. An imbalance of force caused by fluid pressure on first and second hydraulic surfaces 58, 59 may result in movement of piston assembly 48 within tube 46. For example, a force on first hydraulic surface 58 being greater than a force on second hydraulic surface 59 may cause piston assembly 48 to displace to increase the effective length of hydraulic cylinder 16. Similarly, when a force on second hydraulic surface 59 is greater than a force on first hydraulic surface 58, piston assembly 48 will retract within tube 46 to decrease the effective length of hydraulic cylinder 16. A sealing member (not shown), such as an o-ring, may be connected to piston 54 to restrict a flow of fluid between an internal wall of tube 46 and an outer cylindrical surface of piston 54.

Source 24 may be configured to produce a flow of pressurized fluid and may include a pump such as, for example, a variable displacement pump, a fixed displacement pump, or any other source of pressurized fluid known in the art. Source 24 may be drivably connected to a power source (not shown) of work machine 10 by, for example, a countershaft (not shown), a belt (not shown), an electrical circuit (not shown), or in any other suitable manner. Source 24 may be disposed between tank 34 and valve body 90. Source 24 may be dedicated to supplying pressurized fluid only to hydraulic system 22, or alternately may supply pressurized fluid to additional hydraulic systems 55 within work machine 10.

Tank 34 may constitute a reservoir configured to hold a supply of fluid. The fluid may include, for example, a dedicated hydraulic oil, an engine lubrication oil, a transmission lubrication oil, or any other fluid known in the art. One or more hydraulic systems within work machine 10 may draw fluid from and return fluid to tank 34. It is also contemplated that hydraulic system 22 may be connected to multiple separate fluid tanks.

Valve body 90 may include multiple bores and conduits therein. Specifically, valve body 90 may constitute a housing configured to contain, support, and/or constitute various components of hydraulic system 22. Valve body 90 may be in fluid communication with first chamber 50 via a port 92, with second chamber 52 via a port 94, with source 24 via a port 102, and with tank 34 via ports 96, 98, 100. Specifically, ports 92, 94, 96, 98, 100, 102 may be formed at boundaries of valve body 90 and may be configured to permit connection between valve body 90 and source 24, fluid actuator 16, and tank 34. It is contemplated that ports 96, 98, 100, may be formed as a single port or any desirable number of ports to permit connection between valve body 90 and tank 34. Valve body 90 may include a head-end supply valve 26, a head-end drain valve 28, a rod-end supply valve 30, a rod-end drain valve 32, and a proportional pressure compensating valve 36. Valve body 90 may also include a head-end pressure relief valve 38, a head-end makeup valve 40, a rod-end pressure relief valve 42, and a rod-end makeup valve 44. Valve body 90 may also include fluid passageways 60, 62, 64, 66, 68, 78, 82, a shuttle valve 74, a check valve 76, and restrictive orifices 70, 72, 80, 84. It is contemplated that valve body 90 may be an integral housing and may be connected to or mounted on frame 12 in any suitable manner known in the art.

Head-end supply valve 26 may be disposed within valve body 90 in fluid communication with source 24 and first chamber 50 via ports 102 and 92, respectively, and configured to regulate a flow of pressurized fluid to first chamber 50. Specifically, head-end supply valve 26 may include a two-position spring biased valve element 200 supported within a bore 202 formed in valve body 90. Valve element 200 may be solenoid actuated and configured to move between a first position at which fluid is allowed to flow to first chamber 50 and a second position at which fluid flow is blocked from flowing to first chamber 50. It is contemplated that head-end supply valve 26 may include additional or different mechanisms such as, for example, a proportional valve element or any other valve mechanisms known in the art. It is also contemplated that head-end supply valve 26 may alternately be hydraulically actuated, mechanically actuated, pneumatically actuated, or actuated in any other suitable manner. It is further contemplated that head-end supply valve 26 may be configured to allow fluid from first chamber 50 to flow through head-end supply valve 26 via port 92 during a regeneration event when a pressure within first chamber 50 exceeds a pressure directed to head-end supply valve 26 from source 24.

Head-end drain valve 28 may be disposed within valve body 90 in fluid communication with first chamber 50 and tank 34 via ports 92 and 100, respectively, and configured to regulate a flow of pressurized fluid from first chamber 50 to tank 34. Specifically, head-end drain valve 28 may include a two-position spring biased valve element 204 supported within a bore 206 formed in valve body 90. Valve element 204 may be solenoid actuated and configured to move between a first position at which fluid is allowed to flow from first chamber 50 and a second position at which fluid is blocked from flowing from first chamber 50. It is contemplated that head-end drain valve 28 may include additional or different valve mechanisms such as, for example, a proportional valve element or any other valve mechanism known in the art. It is also contemplated that head-end drain valve 28 may alternately be hydraulically actuated, mechanically actuated, pneumatically actuated, or actuated in any other suitable manner.

Rod-end supply valve 30 may be disposed within valve body 90 in fluid communication with source 24 and second chamber 52 via ports 102 and 94, respectively, and configured to regulate a flow of pressurized fluid to second chamber 52. Specifically, rod-end supply valve 30 may include a two-position spring biased valve element 208 supported within a bore 210 formed in valve body 90. Valve element 208 may be solenoid actuated and configured to move between a first position at which fluid is allowed to flow to second chamber 52 and a second position at which fluid is blocked from flowing to second chamber 52. It is contemplated that rod-end supply valve 30 may include additional or different valve mechanisms such as, for example, a proportional valve element or any other valve mechanism known in the art. It is also contemplated that rod-end supply valve 30 may alternately be hydraulically actuated, mechanically actuated, pneumatically actuated, or actuated in any other suitable manner. It is further contemplated that rod-end supply valve 30 may be configured to allow fluid from second chamber 52 to flow through rod-end supply valve 30 via port 94 during a regeneration event when a pressure within second chamber 52 exceeds a pressure directed to rod-end supply valve 30 from source 24.

Rod-end drain valve 32 may be disposed within valve body 90 in fluid communication with second chamber 52 and tank 34 via ports 94 and 100, respectively, and configured to regulate a flow of pressurized fluid from second chamber 52 to tank 34. Specifically, rod-end drain valve 32 may include a two-position spring biased valve element 212 supported within a bore 214 formed in valve body 90. Valve element 212 may be solenoid actuated and configured to move between a first position at which fluid is allowed to flow from second chamber 52 and a second position at which fluid is blocked from flowing from second chamber 52. It is contemplated that rod-end drain valve 32 may include additional or different valve mechanisms such as, for example, a proportional valve element or any other valve mechanism known in the art. It is also contemplated that rod-end drain valve 32 may alternately be hydraulically actuated, mechanically actuated, pneumatically actuated, or actuated in any other suitable manner.

Head-end and rod-end supply and drain valves 26, 28, 30, 32 may be fluidly interconnected. In particular, head-end and rod-end supply valves 26, 30 may be connected in parallel to an upstream common supply fluid passageway 60 and connected to a downstream common signal fluid passageway 62. Upstream common supply fluid passageway 60 and downstream common signal fluid passageway 62 may each be a separate conduit formed in valve body 90 and may connect head-end and rod-end supply valve bores 202, 210. Head-end and rod-end drain valves 28, 32 may be connected in parallel to a downstream common drain passageway 64. Common drain passageway 64 may be a conduit formed in valve body 90 and may connect head-end and rod-end drain valve bores 206, 214 and terminate at port 100 to permit fluid flow to tank 34.

Head-end supply and drain valves 26, 28 may be connected in parallel to a first chamber fluid passageway 61. First chamber fluid passageway 61 may be a conduit formed in valve body 90 that connects head-end supply and drain valve bores 202, 206. The first chamber fluid conduit of passageway 61 may terminate at fluid port 92 formed at a boundary of valve body 90 to permit fluid flow to first chamber 50. Rod-end supply and return valves 30, 32 may be connected in parallel to a second chamber fluid passageway 63. Second chamber fluid passageway 63 may be a conduit formed in valve body 90 and may connect rod-end supply and drain valve bores 210, 212 and may terminate at fluid port 94 to permit fluid flow to second chamber 52.

Head-end pressure relief valve 38 may be fluidly connected to first chamber fluid passageway 61 between first chamber 50 and head-end supply and drain valves 26, 28. Head-end pressure relief valve 38 may have a spring biased valve element (not referenced) supported within a bore (not referenced) formed in valve body 90. The first chamber fluid conduit of passageway 61 may connect the head-end pressure relief valve bore and may terminate at port 96 to permit fluid flow through head-end pressure relief valve 38 to tank 34. The valve element may be spring biased toward a valve closing position and movable to a valve opening position in response to a pressure within first chamber fluid passageway 61 being above a predetermined pressure. In this manner, head-end pressure relief valve 38 may be configured to reduce a pressure spike within hydraulic system 22 caused by external forces acting on work implement 14 and piston 54 by allowing fluid from first chamber 50 to drain to tank 34.

Head-end makeup valve 40 may be fluidly connected to first chamber fluid passageway 61 between first chamber 50 and head-end supply and drain valves 26, 28. Head-end makeup valve 40 may have a valve element (not referenced) supported within a bore (not referenced) formed in valve body 90 and configured to allow fluid from tank 34 into first chamber fluid passageway 61 in response to a fluid pressure within first chamber fluid passageway 61 being below a pressure of the fluid within tank 34. The head-end makeup valve bore may be connected to the first chamber fluid conduit of passageway 61 to permit fluid flow from port 96 through head-end makeup valve 40 to first chamber 50. In this manner, head-end makeup valve 40 may be configured to reduce a drop in pressure within hydraulic system 22 caused by external forces acting on work implement 14 and piston 54 by allowing fluid from tank 34 to fill first chamber 50.

Rod-end pressure relief valve 42 may be fluidly connected to second chamber fluid passageway 63 between second chamber 52 and rod-end supply and drain valves 30, 32. Rod-end pressure relief valve 42 may have a spring biased valve element (not referenced) supported within a bore (not referenced) formed in valve body 90. The second chamber conduit of passageway 63 may connect the head-end pressure relief valve bore and may terminate at port 98 to permit fluid flow through head-end pressure relief valve 42 to tank 34. The valve element may be spring biased toward a valve closing position and movable to a valve opening position in response to a pressure within first chamber fluid passageway 63 being above a predetermined pressure. In this manner, rod-end pressure relief valve 42 may be configured to reduce a pressure spike within hydraulic system 22 caused by external forces acting on work implement 14 and piston 54 by allowing fluid from second chamber 52 to drain to tank 34.

Rod-end makeup valve 44 may be fluidly connected to second chamber fluid passageway 63 between second chamber 52 and rod-end supply and drain valves 30, 32. Rod-end makeup valve 44 may have a valve element (not referenced) supported within a bore (not referenced) formed in valve body 90 and configured to allow fluid from tank 34 into second chamber fluid passageway 63 in response to a fluid pressure within second chamber fluid passageway 63 being below a pressure of the fluid within tank 34. The head-end makeup valve bore may be connected to the second chamber fluid conduit of passageway 63 to permit fluid flow from port 98 through head-end makeup valve 44 to second chamber 52. In this manner, rod-end makeup valve 44 may be configured to reduce a drop in pressure within hydraulic system 22 caused by external forces acting on work implement 14 and piston 54 by allowing fluid from tank 34 to fill second chamber 52.

Valve body 90 may include additional components to control fluid pressures and/or flows within hydraulic system 22. Specifically, valve body 90 may include shuttle valve 74 disposed within downstream common signal fluid passageway 62. Shuttle valve 74 may include a shuttle valve element (not referenced) supported within a bore (not referenced) formed in valve body 90. The shuttle valve bore may be connected to the downstream common signal fluid conduit of passageway 62. Shuttle valve 74 may be configured to fluidly connect the one of head-end and rod-end supply valves 26, 30 having a lower fluid pressure to proportional pressure compensating valve 36 in response to a higher fluid pressure from either head-end or rod-end supply valves 26, 30. In this manner, shuttle valve 74 may resolve pressure signals from head-end and rod-end supply valves 26, 30 to allow the lower outlet pressure of the two valves to affect movement of proportional pressure compensating valve 36. Because shuttle valve 74 allows the lower pressure to affect proportional pressure compensating valve 36 in response to the higher pressure, proportional pressure compensating valve 36 may function correctly even during regeneration events.

Valve body 90 may also include pressure balancing passageways 66, 68 to control fluid pressures and/or flows within hydraulic system 22. Fluid passageways 66, 68 may each be configured as a separate conduit formed in valve body 90 to fluidly connect upstream common supply fluid passageway 60 and downstream common signal fluid passageway 62. Fluid passageways 66, 68 may include restrictive orifices 70, 72, respectively, formed within valve body 90 to minimize pressure and/or flow oscillations within fluid passageways 66, 68. It is contemplated that fluid passageways 66, 68 may alternately be formed as conduits in rod-end and head-end supply valve elements 202, 210, respectively (not shown), and restrictive orifices 70, 72 may be formed within rod-end and head-end valve elements 202, 210 to minimize pressure and/or flow oscillations within fluid passageways 66, 68.

Valve body 90 may also include a check valve 76 disposed between proportional pressure compensating valve 36 and upstream fluid passageway 60. Check valve 76 may include a check valve element (not referenced) supported within valve body 90. It is contemplated that hydraulic system 22 and/or valve body 90 may include additional and/or different components to control fluid pressures and/or flows within hydraulic system 22.

Proportional pressure compensating valve 36 may be a hydro-mechanically actuated proportional control valve disposed between upstream common supply fluid passageway 60 and source 24, and may be configured to control a pressure of the fluid supplied to upstream common supply fluid passageway 60. Specifically, proportional pressure compensating valve 36 may include a pressure compensating valve element 216 supported within a pressure compensating bore 218 formed in valve body 90. The proportional pressure compensating valve element may be connected to the upstream common supply conduit of passageway 60 and may be further connected to port 102, either directly or via an inlet fluid conduit (not referenced) formed in valve body 90. Valve element 216 may be spring and hydraulically biased toward a flow passing position and movable by hydraulic pressure toward a flow blocking position. Proportional pressure compensating valve 36 may be movable toward the flow blocking position by a fluid directed via a fluid passageway 78 from a point between proportional pressure compensating valve 36 and check valve 76. Fluid passageway 78 may be a conduit formed within valve body 90 and may connect pressure compensating bore 218 and the upstream common supply conduit of passageway 60. Fluid passageway 78 may include a restrictive orifice 80 formed in valve body 90 to minimize pressure and/or flow oscillations within fluid passageway 78. Proportional pressure compensating valve 36 may be movable toward the flow passing position by a fluid directed via a fluid passageway 82 from shuttle valve 74. Fluid passageway 82 may be a conduit formed within valve body 90 and may connect the bore of shuttle valve 74 and pressure compensating bore 218. Fluid passageway 82 may include a restrictive orifice 84 formed within valve body 90 to minimize pressure and/or flow oscillations within fluid passageway 82. It is contemplated that pressure compensating valve element 216 may alternately be spring biased toward a flow blocking position, that the fluid from passageway 82 may alternately bias the valve element of proportional pressure compensating valve 36 toward the flow passing position, and/or that the fluid from passageway 78 may alternately move the valve element of proportional pressure compensating valve 36 toward the flow blocking position. It is also contemplated that proportional pressure compensating valve 36 may alternately be located downstream of head-end and rod-end supply valves 26, 30 or in any other suitable location. It is also contemplated that restrictive orifices 80 and 84 may be omitted, if desired.

Figure 3:
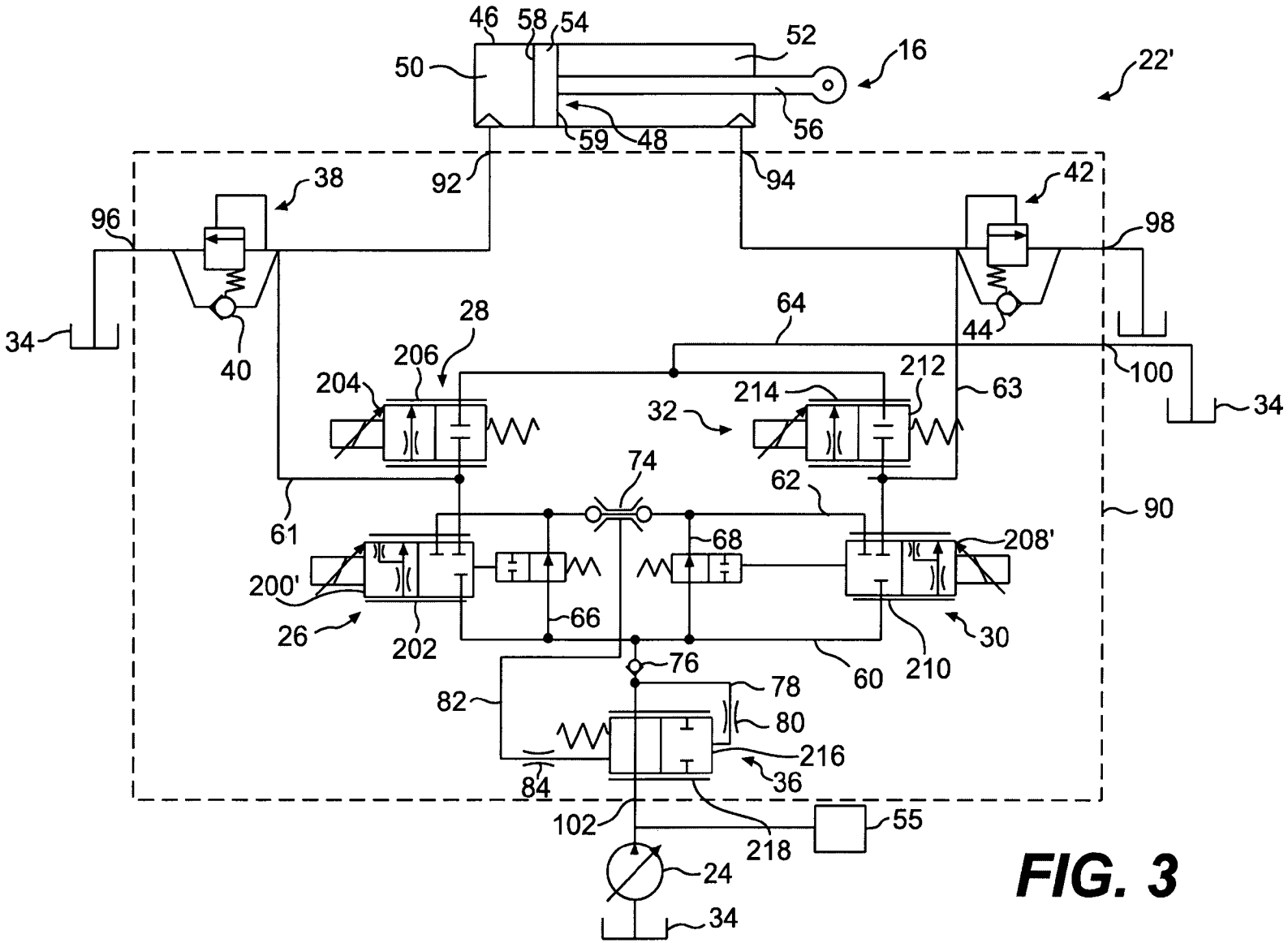
FIG. 3 is a schematic illustration of another exemplary disclosed hydraulic circuit.

As illustrated in FIG. 3, an alternative hydraulic system 22' including various elements that may cooperate to move work implement 14 is disclosed. The description and operation of alternative hydraulic system 22' is similar to hydraulic system 22 as disclosed above and same reference numerals are used to identify like elements of both hydraulic systems 22, 22'. Accordingly, a detailed description of like elements is omitted and only the differences of alternative hydraulic system 22' are disclosed below.

Head-end and rod-end supply valves 26, 30 may be configured to selectively control the fluid flow in pressure balancing passageways 66, 68. Head-end supply valve 26 may include a two-position spring biased valve element 200' supported within bore 202 formed within valve body 90. Similarly, rod-end supply valve 30 may include a two-position spring biased valve element 208' supported within bore 210 formed within valve body 90. Head-end and rod-end valve elements 200' and 208', similar to head-end and rod-end valve elements 200, 208, may be solenoid actuated and configured to move between a first position at which fluid is passed to a respective chamber 50, 52 and a second position at which fluid is blocked from flowing to a respective chamber 50, 52. When one of head-end or rod-end supply valves 26, 30 is moved to a flow passing position and shuttle valve 74 is biased toward the flow passing valve, a blocking portion 201', 209' of the flow passing valve may block fluid flow within one of pressure balancing passageways 66, 68. Similarly, when one of head-end or rod-end supply valves 26, 30 is moved to a flow blocking position and shuttle valve 74 is biased away from the flow blocking valve, blocking portion 201', 209' of the flow blocking valve may allow fluid flow within one of pressure balancing passageways 66, 68. For example, when head-end supply valve 26 is moved to a flow passing position, blocking portion 201' of head-end supply valve element 200' blocks fluid flow in pressure balancing passageway 66. Similarly, when head-end supply valve 30 is moved to a flow passing position, blocking portion 209' of head-end supply valve element 208' blocks fluid flow in pressure balancing passageway 68.

INDUSTRIAL APPLICABILITY

The disclosed hydraulic system may be applicable to any work machine that includes a fluid actuator where balancing of pressures and/or flows of fluid supplied to the actuator is desired. The disclosed hydraulic system may provide high response pressure regulation that protects the components of the hydraulic system and provides consistent actuator performance in a low cost simple configuration. The operation of hydraulic system 22 will now be explained.

Hydraulic cylinder 16 may be movable by fluid pressure in response to an operator input. Fluid may be pressurized by source 24 and directed to valve body 90 via port 102. The pressurized fluid may be further directed from port 102 to head-end and rod-end supply valves 26 and 30. In response to an operator input to either extend or retract piston assembly 48 relative to tube 46, one of head-end and rod-end supply valves 26 and 30 may move to the open position to direct the pressurized fluid to the appropriate one of first and second chambers 50, 52. Substantially simultaneously, one of head-end and rod-end drain valves 28, 32 may move to the open position to direct fluid from the appropriate one of the first and second chambers 50, 52 to tank 34 via port 100 to create a pressure differential across piston 54 that causes piston assembly 48 to move. For example, if an extension of hydraulic cylinder 16 is requested, head-end supply valve 26 may move to the open position to direct pressurized fluid from source 24 to first chamber 50. Substantially simultaneous to the directing of pressurized fluid to first chamber 50, rod-end drain valve 32 may move to the open position to allow fluid from second chamber 52 to drain to tank 34. If a retraction of hydraulic cylinder 16 is requested, rod-end supply valve 30 may move to the open position to direct pressurized fluid from source 24 to second chamber 52. Substantially simultaneous to the directing of pressurized fluid to second chamber 52, head-end drain valve 28 may move to the open position to allow fluid from first chamber 50 to drain to tank 34.

Because multiple actuators may be fluidly connected to source 24, the operation of one of the actuators may affect the pressure and/or flow of fluid directed to hydraulic cylinder 16. If left unregulated, these affects could result in inconsistent and/or unexpected motion of hydraulic cylinder 16 and work implement 14, and could possibly result in shortened component life of hydraulic system 22. Proportional pressure compensating valve 36 may account for these affects by proportionally moving the valve element of proportional pressure compensating valve 36 between the flow passing and flow blocking positions in response to fluid pressures within hydraulic system 22 to provide a substantially constant predetermined pressure drop across all supply valves of hydraulic system 22.

As one of head-end and rod-end supply valves 26, 30 are moved to the flow passing position, pressure within downstream common fluid passageway 62 on the flow passing valve side of shuttle valve 74 may be lower than the pressure of the fluid within the downstream common signal fluid passageway 62 on the flow blocking side of shuttle valve 74. As a result, shuttle valve 74 may be biased by the higher pressure toward the flow passing valve, thereby communicating the lower pressure from the flow passing valve and one of the fluid passageways 66, 68 to proportional pressure compensating valve 36 via passageway 82. This lower pressure communicated to proportional compensating valve 36 may then act together with the force of the proportional pressure compensating valve spring against the pressure from fluid passageway 78. The resultant force may then either move the valve element of proportional pressure compensating valve 36 toward the flow blocking or flow passing positions. As the pressure from source 24 drops, proportional pressure compensating valve 36 may move toward the flow passing position and thereby maintain the pressure within upstream common fluid passageway 60. Similarly, as the pressure from source 24 increases, proportional pressure compensating valve 36 may move toward the flow blocking position to thereby maintain the pressure within upstream common fluid passageway 60. In this manner, proportional pressure compensating valve 36 may regulate the fluid pressure within hydraulic system 22.

Proportional pressure compensating valve 36 may also be configured to reduce pressure and/or flow fluctuations within hydraulic system 22 caused by the occurrence of regeneration processes within hydraulic system 22. In particular, during movement of work implement 14, there may be instances when an external force on work implement 14 generates a pressure within one of first and second chambers 50, 52 that is greater than the pressure of the fluid supplied to head-end or rod-end supply valves 26, 30 by source 24. During these instances, this high pressure fluid may be regenerated to conserve energy. Specifically, this high pressure fluid may be directed from the appropriate one of first and second chambers 50, 52 to upstream common fluid passageway 60. Proportional pressure compensating valve 36 may accommodate this supply of high pressure fluid by moving the valve element of proportional pressure compensating valve 36 toward the flow blocking position. In this manner, proportional pressure compensating valve 36 may provide substantially constant pressure even during regeneration processes.

The operation of hydraulic system 22' is similar to that of hydraulic system 22 with the following difference. As one of head-end and rod-end supply valves 26, 30 are moved to the flow passing position, pressure within downstream common signal fluid passageway 62 on the flow passing valve side of shuttle valve 74 may be lower than the pressure of the fluid within the downstream common signal fluid passageway 62 on the flow blocking side of shuttle valve 74. As a result, shuttle valve 74 may be biased by the higher pressure toward the flow passing valve, thereby communicating only the lower pressure from the flow passing valve to proportional pressure compensating valve 36 as fluid flow within one of fluid passageways 66,68 may be blocked. For example, as head-end supply valve 26 moves to a flow passing position, valve element 200' may block fluid flow within fluid passageway 66. Shuttle valve 74 may be biased by higher pressure toward head-end supply valve 26 thereby communicating low pressure from head-end supply valve 26 to fluid passageway 82. Because valve element 200' may block fluid flow in pressure balancing fluid passageway 66, shuttle valve 74 may only communicate low pressure from head-end supply valve 26 to proportional pressure compensating valve 36 thereby reducing the fluid flow of low pressure communicated shuttle valve 74.

Various components may be included in valve body 90. In particular, valve body 90 may provide a compact hydraulic valve unit and may realize reductions in space and/or material potentially reducing material and manufacturing costs. Valve body may further improve reliability by reducing the number of hydraulic line junctions thus potentially reducing leaks and/or chances of failure and improving signal strength and/or response timing.

Because of proportional pressure compensating valve 36 is hydro-mechanically actuated, pressure fluctuations may be quickly accommodated before they can significantly influence motion of hydraulic cylinder 16 or life of components. In particular, the response time of proportional pressure compensating valve 36 may be about 200 hz or higher, which is much greater than typical solenoid actuated valves that respond at about 5–15 hz. In addition, because proportional pressure compensating valve 36 may be hydro-mechanically actuated rather than electronically controlled, the cost may be minimized.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system, comprising:

a source of pressurized fluid;

a fluid actuator having a first chamber and a second chamber;

a first valve configured to selectively fluidly communicate the source with the first chamber;

a second valve configured to selectively fluidly communicate the source with the second chamber;

a supply passageway configured to direct pressurized fluid from the source to the first and second valves in parallel;

a signal passageway disposed between the first and second valves, the first and second valves being connected in parallel with the signal passageway;

a proportional pressure compensating valve configured to control a pressure of a fluid directed between the source and the first and second valves; and at least one pressure balancing passageway disposed between the supply and the signal fluid passageways to fluidly communicate the supply and signal passageways.

2. The hydraulic system of claim 1, wherein the at least one pressure balancing passageway is a first pressure balancing passageway and the hydraulic system further includes a second pressure balancing passageway disposed between the supply and the signal passageways to fluidly communicate the supply and signal passageways.

3. The hydraulic system of claim 2, further including:

a shuttle valve disposed within the signal passageway between the first and second pressure balancing passageways;

wherein the shuttle valve selectively passes pressurized fluid from the signal passageway in response to a fluid pressure.

4. The hydraulic system of claim 3, wherein:

the proportional pressure compensating valve is disposed between the source and the supply passageway; and the shuttle valve passes pressurized fluid to the proportional pressure compensating valve.

5. The hydraulic system of claim 4, wherein:

the first and second pressure balancing passageways pass pressurized fluid from the supply passageway to the signal passageway; and the shuttle valve selectively passes pressurized fluid from one of the first and second valves to the proportional pressure compensating valve.

6. The hydraulic system of claim 4, wherein:

the first and second pressure balancing passageways pass pressurized fluid from the supply passageway to the signal passageway; and the shuttle valve selectively passes a combination of pressurized fluid from one of the first and second valves and pressurized fluid from one of the first and second pressure balancing passageways to the proportional pressure compensating valve.

7. The hydraulic system of claim 2, wherein:

the first valve is further configured to selectively block a flow of pressurized fluid in the first pressure balancing passageway when the first valve selectively fluidly communicates the source with the first chamber; and the second valve is further configured to selectively block flow of pressurized fluid in the second pressure balancing passageway when the second valve selectively fluidly communicates the source with the second chamber.

8. The hydraulic system of claim 1, wherein the first valve is further configured to selectively block a flow of pressurized fluid in the at least one pressure balancing passageway when the first valve selectively fluidly communicates the source with the first chamber.

9. A hydraulic valve unit, comprising:

a body including:

a first valve configured to selectively fluidly communicate a source of pressurized fluid with a first chamber of a fluid actuator;

a second valve configured to selectively fluidly communicate the source with a second chamber of the fluid actuator;

a proportional pressure compensating valve configured to control a pressure of fluid directed between the source and the first and second valves dependent on a load acting on the fluid actuator;

a supply passageway disposed between the source and the first and second valves, wherein the first and second valves are connected to the supply passageway in parallel and the proportional pressure compensating valve is disposed within the supply passageway.

10. The hydraulic valve unit of claim 9, wherein the body further includes:

a third valve configured to selectively fluidly communicate a tank with the first chamber; and a fourth valve configured to selectively fluidly communicate the tank with the second chamber.

11. The hydraulic valve unit of claim 10, wherein each of the first, second, third, and fourth valves are solenoid actuated proportional control valves.

12. The hydraulic valve unit of claim 9, wherein the body further includes:

a signal passageway disposed downstream of the first and second valves, the first and second valves being in fluid communication with the signal passageway; and a shuttle valve disposed within the signal passageway between the first and second valves, wherein the shuttle valve selectively opens in response to a fluid pressure.

13. The hydraulic valve unit of claim 12, further including:

at least one pressure balancing passageway disposed between the supply and signal passageways.

14. The hydraulic valve unit of claim 13, wherein the at least one pressure balancing passageway is a first pressure balancing passageway and the hydraulic valve unit further includes a second pressure balancing passageway disposed between the supply and signal passageways.

15. The hydraulic valve unit of claim 14, wherein:

the first and second pressure balancing passageways pass pressurized fluid from the supply passageway to the signal passageway; and the shuttle valve selectively passes pressurized fluid from one of the first and second valves to the proportional pressure compensating valve.

16. The hydraulic valve unit of claim 14, wherein:

the first and second pressure balancing passageways pass pressurized fluid from the supply passageway to the signal passageway; and the shuttle valve selectively passes a combination of pressurized fluid from one of the first and second pressure balancing passageways and pressurized fluid from one of the first and second valves to the proportional pressure compensating valve.

17. The hydraulic valve unit of claim 14, wherein:

the first valve is further configured to selectively block a flow of pressurized fluid in the first pressure balancing passageway when the first valve selectively fluidly communicates the source with the first chamber; and the second valve is further configured to selectively block flow of pressurized fluid in the second pressure balancing passageway when the second valve selectively fluidly communicates the source with the second chamber.

18. The hydraulic valve unit of claim 13, wherein the first valve is further configured to selectively block a flow of pressurized fluid in the at least one pressure balancing passageway when the first valve selectively fluidly communicates the source with the first chamber.

19. The hydraulic valve unit of claim 12, wherein the body further includes:

a third fluid passageway configured to direct pressurized fluid from one of the first and second valves via the shuttle valve to the proportional pressure compensating valve to bias a proportional pressure compensating valve element between a flow passing and a flow blocking position.

20. The hydraulic valve unit of claim 9, wherein the body further includes:

a check valve disposed between the proportional pressure compensating valve and the first and second valves.

21. The hydraulic valve unit of claim 9, wherein the body further includes:

at least one pressure relief valve fluidly connected to one of the first chamber and the second chamber, the at least one pressure relief valve being configured to communicate the one of the first and second chambers with the tank in response to a fluid pressure within the one of the first and second chambers exceeding a predetermined pressure.

22. The hydraulic valve unit of claim 9, wherein the body further includes:

at least one makeup valve fluidly connected to one of the first and second chambers, the at least one makeup valve being configured to communicate one of the first and second chambers with the tank in response to a fluid pressure within the one of the first and second chambers dropping below a predetermined pressure.

23. A method of operating a hydraulic system, comprising:

pressurizing a fluid;

directing pressurized fluid to a first valve in communication with a first chamber of an actuator via a supply passageway;

directing pressurized fluid to a second valve in communication with a second chamber of the actuator via the supply passageway;

selectively operating at least one of the first and second valves to move the actuator;

directing pressurized fluid from a signal passageway disposed downstream of the first and second valves to a pressure compensating valve element;

directing pressurized fluid from the supply passageway to the signal passageway via at least one pressure balancing passageway;

moving the pressure compensating valve element in response to a pressure differential between an inlet of one of the first and second valves and the signal passageway to maintain a predetermined differential across at least one of the first and second valves within a predetermined range of desired pressure differential.

24. The method of claim 23, wherein the at least one pressure balancing passageway is a first pressure balancing passageway, and the method further includes directing pressurized fluid from the supply passageway to the signal passageway via a second pressure balancing passageway.

25. The method of claim 24, wherein selectively operating at least one of the first and second valves further includes:

moving a valve element of one of the first and second valves to pass pressurized fluid from the supply passageway to the actuator and to selectively block flow of pressurized fluid in the first pressure balancing passageway; and moving a valve element of the other of the first and second valves to pass pressurized fluid from the supply passageway to the actuator and to selectively block flow of pressurized fluid in the second pressure balancing passageway.

26. The method of claim 23, further including, directing pressurized fluid from the signal passageway to the pressure compensating valve element via a shuttle valve in response to a pressure.

27. The method of claim 23, wherein selectively operating at least one of the first and second valves further includes selectively blocking flow of pressurized fluid in the at least one pressure balancing passageway.

28. A work machine, comprising:

a work implement; and a hydraulic system, including:

a source of pressurized fluid;

a tank;

a valve body including:

a first valve configured to selectively fluidly communicate the source with a first chamber of a fluid actuator;

a second valve configured to selectively fluidly communicate the source with a second chamber of the fluid actuator;

a proportional pressure compensating valve to control a pressure of fluid directed between the source and the first and second valves;

a shuffle valve disposed within a signal passageway between the first and second valves, wherein the shuffle valve is configured to selectively fluidly communicate pressurized fluid associated with the one of the first and second valves having a lower pressure than the pressurized fluid associated with the other one of the first and second valves toward the proportional pressure compensating valve;

a supply passageway disposed between the source and the first and second valves, wherein the first and second valves are connected to the supply passageway in parallel and the proportional pressure compensating valve is disposed within the supply passageway.

29. The work machine of claim 28, wherein the body further includes:

a third valve configured to selectively fluidly communicate the tank with the first chamber; and a fourth valve configured to selectively fluidly communicate the tank with the second chamber.

30. The work machine of claim 29, wherein each of the first, second, third, and fourth valves are solenoid actuated proportional control valves.

31. The work machine of claim 28, wherein the signal passageway is disposed downstream of the first and second valves, the first and second valves being in fluid communication with the signal passageway.

32. The work machine of claim 28, wherein the hydraulic system further includes:

at least one pressure balancing passageway disposed between the supply and signal passageways.

33. The work machine of claim 32, wherein the at least one pressure balancing passageway is a first pressure balancing passageway and the hydraulic valve unit further includes a second pressure balancing passageway disposed between the supply and signal passageways.

34. The work machine of claim 33, wherein:

the first and second pressure balancing passageways pass pressurized fluid from the supply passageway to the signal passageway; and the shuffle valve selectively passes pressurized fluid from one of the first and second valves to the proportional pressure compensating valve.

35. The work machine of claim 33, wherein:

the first and second pressure balancing passageways pass pressurized fluid from the supply passageway to the signal passageway; and the shuttle valve selectively passes a combination of pressurized fluid from one of the first and second pressure balancing passageways and pressurized fluid from one of the first and second valves to the proportional pressure compensating valve.

36. The work machine of claim 33, wherein:

the first valve is further configured to selectively block a flow of pressurized fluid in the first pressure balancing passageway when the first valve selectively fluidly communicates the source with the first chamber; and the second valve is further configured to selectively block flow of pressurized fluid in the second pressure balancing passageway when the second valve selectively fluidly communicates the source with the second chamber.

37. The work machine of claim 32, wherein the first valve is further configured to selectively block a flow of pressurized fluid in the at least one pressure balancing passageway when the first valve selectively fluidly communicates the source with the first chamber.

38. The work machine of claim 28, wherein the body further includes:

a third fluid passageway configured to direct pressurized fluid from one of the first and second valves via the shuttle valve to the proportional pressure compensating valve to bias a proportional pressure compensating valve element between a flow passing and a flow blocking position.

39. The work machine of claim 28, wherein the body further includes:

a check valve disposed between the proportional pressure compensating valve and the first and second valves.

40. The work machine of claim 28, wherein the body further includes:

at least one pressure relief valve fluidly connected to one of the first chamber and the second chamber, the at least one pressure relief valve being configured to communicate the one of the first and second chambers with the tank in response to a fluid pressure within the one of the first and second chambers exceeding a predetermined pressure.

41. The work machine of claim 28, wherein the body further includes:

at least one makeup valve fluidly connected to one of the first and second chambers, the at least one makeup valve being configured to communicate the one of the first and second chambers with the tank in response to a fluid pressure within the one of the first and second chambers dropping below a predetermined pressure.

* * * * *

UNITED STATES PATENT AND TRADEMARK OFFICE

CERTIFICATE OF CORRECTION

PATENT NO. : 7,204,185 B2
APPLICATION NO. : 11/117385
DATED : April 17, 2007
INVENTOR(S) : Ma et al.

It is certified that error appears in the above-identified patent and that said Letters Patent is hereby corrected as shown below:

On the cover page:

On Page 2 item (56), under "U.S. Patent Documents", in Column 2, Line 20, delete "2003/0196454" and insert --2003/0196545--.

In the claims:

In Column 15, Line 16, in Claim 28, delete "shuffle" and insert --shuttle--.

In Column 15, Line 18, in Claim 28, delete "shuffle" and insert --shuttle--.

In Column 15, Line 56, in Claim 34, delete "shuffle" and insert --shuttle--.

Signed and Sealed this

Sixth Day of May, 2008

JON W. DUDAS
*Director of the United States Patent and Trademark Office*